United States Patent [19]

McKechnie

[11] 4,434,876

[45] Mar. 6, 1984

[54] GUIDE ROLLER FOR SKIP OR CAGE

[75] Inventor: Ronald M. K. McKechnie, Vaal Reefs, South Africa

[73] Assignee: Vaal Reefs Exploration and Mining Company Limited, Johannesburg, South Africa

[21] Appl. No.: 512,572

[22] Filed: Jul. 11, 1983

Related U.S. Application Data

[63] Continuation of Ser. No. 221,449, Dec. 30, 1980, abandoned.

[30] Foreign Application Priority Data

Jan. 4, 1980 [ZA] South Africa ..... 80/0058

[51] Int. Cl.[3] ..... B66B 7/02

[52] U.S. Cl. ..... 187/95; 267/168

[58] Field of Search ..... 187/95, 9 R; 267/168, 267/170, 177, 166

[56] References Cited

U.S. PATENT DOCUMENTS

| | | | |
|---|---|---|---|
| 1,088,523 | 2/1914 | Boidot | 267/168 |
| 1,302,601 | 5/1919 | Smith | 187/95 |
| 1,854,976 | 4/1932 | Brady | 187/95 |
| 1,916,365 | 7/1933 | Dunlop | 187/95 |
| 2,253,820 | 8/1941 | Spiro | 187/95 |
| 3,559,976 | 2/1971 | Jerz, Jr. | 267/168 |
| 3,637,174 | 1/1972 | Kuo | 267/168 |
| 3,669,222 | 6/1972 | Takamura et al. . | |

FOREIGN PATENT DOCUMENTS

| | | | |
|---|---|---|---|
| 1601771 | 10/1956 | Fed. Rep. of Germany | 187/95 |
| 973356 | 2/1960 | Fed. Rep. of Germany . | |
| 973530 | 3/1960 | Fed. Rep. of Germany . | |
| 1160149 | 7/1964 | Fed. Rep. of Germany . | |
| 1169627 | 11/1964 | Fed. Rep. of Germany . | |
| 1269789 | 1/1965 | Fed. Rep. of Germany | 187/95 |
| 1251925 | 4/1968 | Fed. Rep. of Germany . | |
| 1274882 | 12/1960 | France | 187/95 |
| 759621 | 10/1956 | United Kingdom . | |
| 787386 | 12/1957 | United Kingdom . | |
| 848964 | 9/1960 | United Kingdom . | |
| 944222 | 12/1963 | United Kingdom . | |
| 1216391 | 9/1967 | United Kingdom . | |
| 1091058 | 11/1967 | United Kingdom . | |

*Primary Examiner*—Joseph J. Rolla
*Assistant Examiner*—Kenneth Noland
*Attorney, Agent, or Firm*—Murray & Whisenhunt

[57] ABSTRACT

The invention provides a guiding arrangement for a skip, cage, lift or the like wherein guide rollers on opposed sides of the skip are urged against guides which flank the skip, each by way of first and second biasing springs. The first biasing spring has a lower load resisting capacity than the second biasing spring and upon a predetermined deflection of the first biasing spring the second biasing spring is brought into action to resist further deflection.

23 Claims, 4 Drawing Figures

GUIDE ROLLER FOR SKIP OR CAGE

This application is a continuation of application Ser. No. 221,449 filed Dec. 30, 1980, now abandoned.

This invention relates to a guide roller suitable for a skip, cage or like conveyance.

With conventional skip or cage systems, guide shoes on the skip mate with guides which normally flank the skip on all sides. However, guide rollers which engage the guides perform the actual guiding function and serve to minimise physical contact between the guide shoes and guides, and thus ensure relatively friction free movement of the skip. In conventional arrangements the guide rollers are urged into contact with the guides by means of compression springs or rubber packs, and in order to ensure skip stability these have a relatively high resistance against deflection. As a result of the high resistance against deflection of the springs, the roller assemblies are required to be robust and weighty and thus reduce payloads; and the rollers are subject to rapid wear. Moreover the rollers tend to break away from the guide surfaces where irregularities thereon occur and this also contributes to wear. It has further been found that under certain conditions the skip will tend to sway and the rollers will fail to hold the guide shoes clear of the guides resulting in considerable wear of these elements.

It is accordingly an object of the present invention to provide a novel guide roller system which it is believed will reduce the problems associated with conventional systems.

According to the invention a guide roller assembly suitable for a skip, cage, lift or the like, comprises a guide engaging wheel, roller or the like, and first and second biasing means associated with the wheel and adapted in use to urge the wheel against a guide, the first biasing means having a lower load bearing capacity than the second biasing means, the arrangement being such that when a load is applied to the wheel and upon a predetermined deflection thereof, the second biasing means is brought into force to resist the load.

In most instances the guide engaging wheel will be disposed towards the free end of an arm member adapted to be secured to the skip.

Further according to the invention the biasing means are arranged in series to act on the wheel simultaneously, the first biasing means being rendered inoperative upon a predetermined deflection of the wheel against the action of the biasing means. In one arrangement the first biasing means could be rendered inoperative simply by permitting it to compress to its full extent, where the first biasing means is in the nature of a compression spring, block, pack or the like. Preferably however, stop means will be provided to render the spring inoperative. Where a compression spring or pack is in question the stop means may be in the nature of a shielding cup into which the spring can be compressed and which will serve to prevent further compression thereof. Where the first biasing means is adapted to operate in tension the stop could simply comprise a length of rope chain or the like adapted to limit the extent of elongation of the biasing means.

In one arrangement the arm member of the assembly may be of a telescoping type with the biasing means in the form of compression springs arranged concentrically thereon. Preferably however the arm member will be in the nature of a lever adapted to be pivotally mounted on a support for pivotal movement of the wheel towards the guide, with the biasing means acting transversely on the lever arm. Where the biasing means act under compression it is preferred that a pull rod be provided for compressing the biasing means against the lever arm, the rod being pivotally mounted on the support transversely to intersect the lever arm, with the biasing means being disposed at the free end of the rod, the latter having an abutment which acts in use to urge the biasing means against the lever arm. Preferably also the distance between the abutment on the pull rod and the lever arm will be adjustable to vary the degree of compression of the biasing means.

Also according to the invention indicator means is provided for showing the degree of tension or compression, as the case may be, of the biasing means. Where the first biasing means is rendered inoperative by means of a shielding cup the latter may also conveniently act as an indicator means, the linear distance which the biasing means is compressed into the cup serving to indicate the degree of compression. Thus where, in use, identical guide assemblies of the invention oppose one another each assembly will be adjusted so that an equal length of biasing means projects from the cup of each assembly, indicating equal bias of the respective guide assemblies.

Also included within the scope of this invention is a method of guiding a skip, cage, lift or the like relative to a guide comprising the steps of providing the guide roller assembly substantially as disclosed herein, urging the wheel into contact with the guide means of the first biasing means; rendering the first biasing means inoperative when the wheel is subjected to load and deflected a predetermined distance against the action of the bias; and simultaneously bringing the second biasing means into action to resist the load.

Further according to the invention the method includes the step of reintroducing the force of the first biasing means when the wheel returns to its undeflected position.

Also according to the invention the first biasing means is rendered inoperative upon a relatively small deflection, in the order of 0.1 to 10 mm, preferably 1 mm.

Still further according to the invention the method includes the step of providing a second guide roller assembly in opposed relationship to the first guide roller assembly, with the first biasing means of the respective assemblies being adjusted to act with equal force. Preferably the respective first biasing means will be effectively identical and be compressed equally so as to provide equal, opposed, biasing forces and so as to become inoperative upon an equal degree of deflection of the cage in one direction or the other.

The invention is further directed separately to a guide system for a skip, cage, lift or the like comprising a plurality of pairs of the guide assemblies disclosed herein, the assemblies of a pair being arranged in opposed relationship with the first biasing means of the pair being adapted to be adjusted to act upon their respective guide wheels with equal force.

In order to illustrate the invention some embodiments thereof are described hereunder purely by way of example with reference to the accompanying drawings, wherein.

Figure 2:
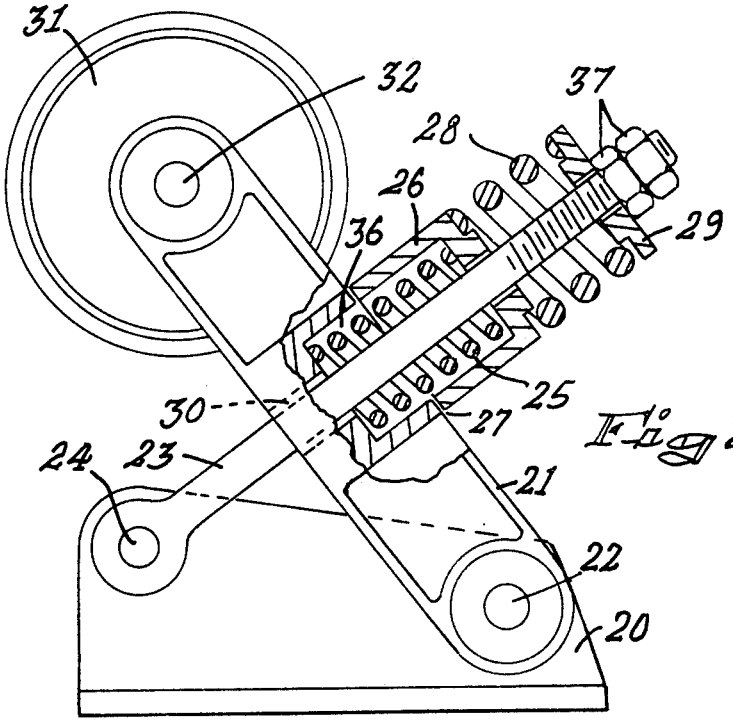
FIG. 2 is a partially sectioned elevation of a guide roller assembly.

With reference to FIG. 2, a guide roller assembly for a skip, cage or the like conveyance, comprises a lever arm 21 which is pivotally mounted on a support 20 at its one end, at 22. The other end of the lever arm 21 is provided with a guide wheel 31 rotatably mounted thereon at 32. In use the support 20 will be mounted on the skip or cage, not shown, while the guide wheel 31 will engage a guide, not shown. The guide wheel 31 will be urged in an anti-clockwise direction, in FIG. 2 to engage such guide, by means of a first compression spring 25 and a second compression spring 28 which are arranged in series to act transversely on the lever arm 21, the compression spring 28 having a greater resistance to load than the spring 25, and being adapted to resist excessive clockwise loading on the guide wheel 31.

In a preferred embodiment, the springs 25 and 28 will be urged against the lever arm 21 by means of a pull rod 23 which is pivotally mounted on the support 20, and which intersects the support arm 21 transversely. In the arrangement in FIG. 2 the pull rod passes transversely through the lever arm 21, through an aperture 30 therein, and is provided with a stop formation 29 for the spring 28 towards its free end.

The stop formation 29 serves to compress spring 28 against a shielding cup 26, for the spring 25, the shielding cup 26 being co-axially disposed with, and axially movable on the pull rod 23. When the spring 25 is compressed to a desired degree, through clockwise pivotal movement of the arm 21, the shielding cup 26 will abut the arm 21 and further clockwise movement of the arm 21 will compress only the spring 28.

From a structural point of view the arrangement in FIG. 2 further makes provision for a recess 36 in the arm 21 for the spring 25, for locating purposes.

Figure 3:
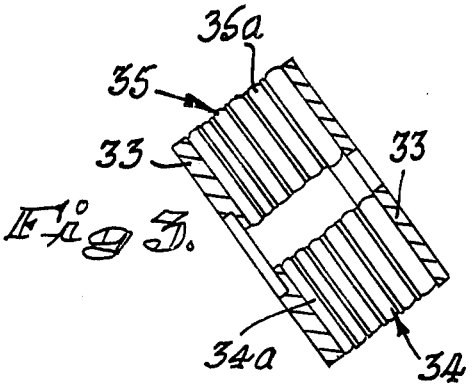
FIG. 3 is a sectioned elevation of a compressible pack suitable for use with the assembly in FIG. 2, in a different embodiment thereof.

The assembly illustrated in FIG. 2 shows spring 25 and spring 28 as single coil springs, but if desirable, either or both could be replaced with rubber packs of multiple springs or packs arranged in parallel. Either or both springs could for example be replaced by a twin pack arrangement such as illustrated in FIG. 3. In the case of the spring 25 however it is necessary that a relatively large measure of elongation be obtained. In the arrangement in FIG. 3 a series of wafers 34(a) of rubber or the like are laminated together to provide a pack 34 which is disposed between end plates 33. A parallely disposed pack 35 is likewise provided. In an alternative arrangement the packs 34 and 35 could be replaced by compression springs, and doubtless many other variations are also possible.

Figure 1:
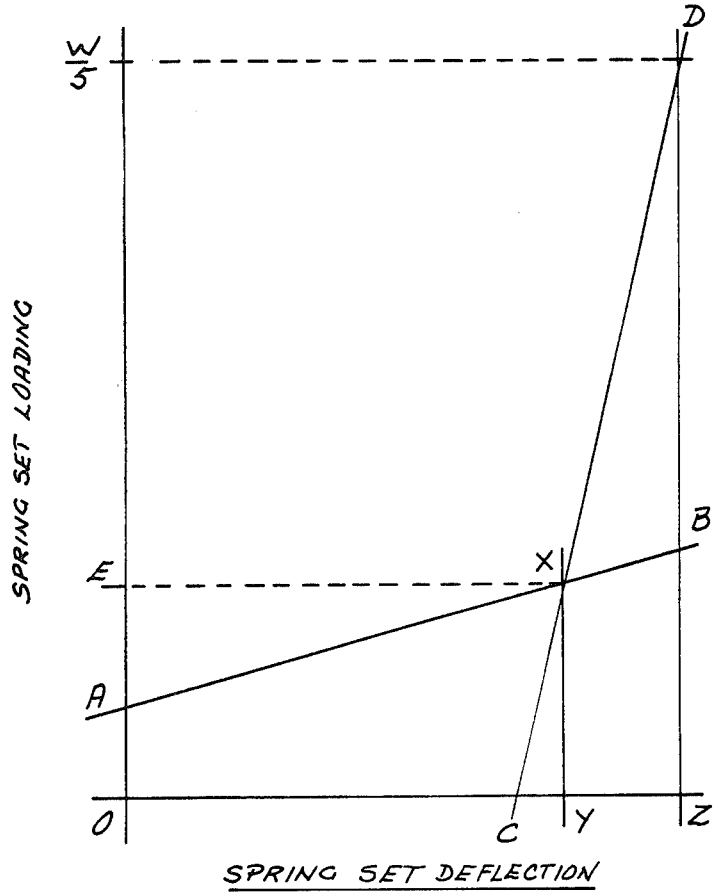
FIG. 1 is a graphic representation of spring loading against spring deflection, of a guide roller assembly in accordance with the invention.

The load/deflection characteristics of the springs 25 and 28 are set out in FIG. 1, with AB representing spring 25, and CD spring 28 with its considerably higher load resistance. In use the system will be set to operate at the point X or very close thereto and the loading on the guide wheel 31 will then equal E. Adjustment of the system is effected by adjusting the threaded nuts 37 until the gap 27 between the shielding cup 26 and the arm 21 is minimised. Thus should the cage or the like to which the guide assembly is secured move away from the guide, the guide wheel 31 will remain in contact, moving in an anti-clockwise direction, FIG. 2, and assume a position along the line XA, FIG. 1. Where the conveyance is thrust towards the guide as a result of lateral forces, the guide roller 31 will move in an clockwise direction, closing the gap 27 and thus compressing only the spring 28, FIG. 2, and assume a position along the lines XD FIG. 1. At a predetermined deflection Z a rigid guide shoe of the conveyance will contact the guide and prevent further deflection, and it is envisaged that at such point the loading on the guide wheel 31 will be in the order of 1/5 of the total weight of the conveyance including its pay-load.

In use a plurality of pairs of the guide assemblies of the invention will be provided for a conveyance, the assemblies of each pair being arranged to oppose one another. A feature of the invention is that with such an arrangement a quick self-centering effect will be obtained. Thus when one guide roller 31 moves along its load/deflection line XA, the opposed guide roller 31 will move along its load/deflection line XB, and vice versa thus providing for rapid return of both guide rollers 31 to their equilibrium points X. It will be appreciated that with all factors being equal the opposed assemblies will be in equilibrium when the respective assemblies are adjusted to display the same gap 27, between their respective spring cups 26 and lever arms 21. The invention thus provides for ready and exact adjustment of the guide system of a conveyance.

Figure 4:
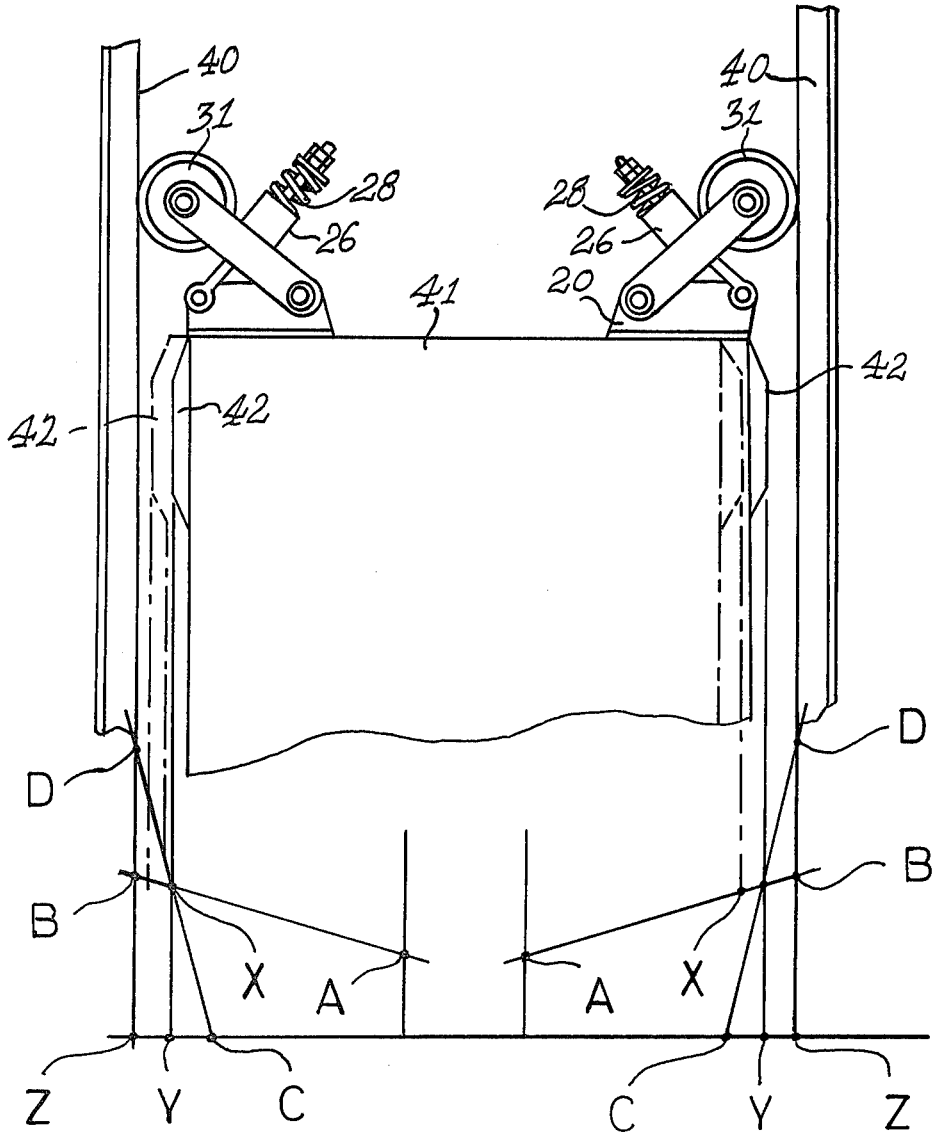
FIG. 4 is a partial side elevation showing the assemblies of FIG. 2 mounted on a conveyance.

FIG. 4 indicates such an arrangement wherein a conveyance 41 having opposed guide shoes 42 is adapted to move between guide rails 40 with the shoes 42 cleaving with the rails 40 during normal operation. As illustrated, a pair of guide assemblies in accordance with the invention are provided on the roof of the conveyor 41 for stabilizing it in respect of leftward and rightward movement. In practice, such a pair of opposing assemblies will also be provided at the base of the conveyance 41 and further pairs of opposing assemblies are provided to stabilize the conveyance 41 against movement perpendicular to the plane of the drawing in the conventional manner.

In FIG. 4 the characteristics of the springs of the wheel assemblies as shown graphically in FIG. 1 are reproduced below each assembly in FIG. 4 below the conveyance 41. The opposing assemblies will be adjusted so that the gap 27, FIG. 2, is the same for both assemblies, thus causing the springs of the assemblies to be in equilibrium and a clearance between the shoes 42 and the rails 40 the same on both sides, namely, Y,Z. Both assemblies will thus operate at the point X on the respective graphs. Should the conveyance 41 move to the left as indicated by the broken lines, FIG. 4, the load on the left hand guide roller will increase along the load curve XD while the right hand roller moves along the lesser load curve XA. The equilibrium is thus upset and the conveyance will tend to move back to the position of equilibrium thus providing centre seeking characteristics.

When opposed assemblies are in equilibrium the opposed rollers 31 will move outwardly equally where there is a bulge in the opposed guides thus maintaining the conveyance in a central position between the guides, the rollers following their load/deflection curves XA. Likewise the roller 31 will move inwardly equally where there is a constriction in the opposed guides, the rollers moving along their load/deflection curves XD. In general it has also been found that the system of the invention will overcome or at least minimise most of the disadvantages encountered with conventional guide systems.

We claim:

1. A guide roller assembly suitable for a skip, cage, lift or the like, comprising:

guide engaging roller means for engaging a guide of said skip, cage, lift or the like;

first and second biasing means operatively connected to said roller means for urging said roller means into rolling contact with said guide;

said first biasing means having a lower load bearing capacity than said second biasing means, said first and second biasing means cooperating such that when the guide roller assembly moves towards said guide, said roller means is deflected against the action of said first biasing means by a predetermined distance, whereupon said first biasing means is rendered inoperative and said second biasing means is simultaneously brought into action to resist said load, and when said guide roller assembly moves away from said guide, said first biasing means undergoes extension to maintain said roller means in contact with said guide, there being no coupling of said first and second biasing means and no extension of said second biasing means during said extension of said first biasing means.

2. The assembly according to claim 1, wherein the first and second biasing means are arranged in series to act on the roller means in sequence.

3. The assembly according to claim 2 wherein the first biasing means is rendered inoperative by permitting it to compress to its full extent, where such biasing means is in the nature of a compression spring, compression block, compression pack or the like.

4. The assembly according to claim 2 wherein stop means is provided to render the first biasing means inoperative.

5. The assembly according to claim 4 wherein the first biasing means is in the nature of a compression spring, compression block, compression pack or the like, and the stop means is in the form of a shielding cup into which the spring can be compressed and which serves to prevent further compression of the spring once the latter is disposed within the shielding cup.

6. The assembly according to claim 1 wherein the guide engaging roller means is disposed towards the free end of an arm member which is adapted to be secured to the skip, cage, lift, or the like.

7. The assembly according to claim 6 wherein the arm member of the assembly is in the nature of a lever adapted to be pivotally mounted on a support for pivotal movement of the wheel towards the guide, with the biasing means acting transversely on the lever arm.

8. The assembly according to claim 7 wherein the first and second biasing means act under compression and a pull rod is provided for compressing the biasing means against the lever arm, the pull rod being pivotally mounted on the support transversely to intersect the lever arm, with the biasing means being disposed at the free end of the rod, a latter having an abutment which acts in use to urge the biasing means against the lever arm.

9. The assembly according to claim 8 wherein the distance between the abutment on the pull rod and the lever arm is adjustable to vary the degree of compression of the biasing means.

10. The assembly according to claim 6 wherein the arm member is movable and the biasing means act on the arm member in use to urge the roller means into contact with the guide, and indicator means is provided for showing the degree of tension or compression as the case may be of the biasing means.

11. The assembly according to claim 10 wherein the first biasing means is rendered inoperative by means of a shielding cup upon a predetermined compression of such first biasing means into the shielding cup and the shielding cup acts as the indicator means, the linear distance which the biasing means is compressed into the cup serving to indicate the degree of compression thereof.

12. The assembly according to claim 6, wherein the arm member of the assembly is comprised of telescoping members, with said first and second biasing means being in the form of compression springs arranged concentrically on said telescoping members.

13. A guide roller assembly according to claim 1 wherein said predetermined distance is about 0.1 to 10 mm.

14. A method of guiding a skip, cage, lift or the like, relative to a guide, said method comprising the steps of:

providing a guide roller assembly comprising a guide engaging roller means for engaging said guide of said skip, cage, lift or the like, and first and second biasing means operatively connected to said roller means for urging said roller means into rolling contact with said guide, said first biasing means having a lower load bearing capacity than said second biasing means, said first and second biasing means cooperating such that when the guide roller assembly moves towards said guide, said roller means is deflected against the action of said first biasing means by a predetermined distance, whereupon the first biasing means is rendered inoperative and the second biasing means is simultaneously brought into action to resist said load, and when said guide roller assembly moves away from said guide, said first biasing means undergoes extension to maintain said roller means in contact with said guide, there being no coupling of said first and second biasing means and no extension of said second biasing means during said extension of said first biasing means.

15. The method according to claim 14 including the step of reintroducing the force of the first biasing means when the wheel returns to its undeflected position.

16. The method according to claim 14 or 15 including the step of providing a further guide roller assembly in opposed relationship to the guide roller assembly, with the first biasing means of the respective assemblies being adjusted to act with equal force.

17. The method according to claim 16 wherein the respective first biasing means will be effectively identical and be compressed equally so as to provide equal opposed biasing forces; and so as to become inoperative upon an equal degree of deflection of the cage in one direction or the other.

18. The method according to claim 14 or claim 15 wherein the first biasing means is rendered inoperative upon a relatively small deflection in the order of 0.1 to 10 mm.

19. The method according to claim 18 wherein the first biasing means is rendered inoperative upon a deflection of approximately 1 mm.

20. The method according to claim 14 including the step of providing a further guide roller assembly in opposed relationship to the guide roller assembly, with the first biasing means of the respective assemblies being adjusted to act with equal force.

21. A guide system for a skip, cage, lift or the like, comprising a plurality of pairs of guide assemblies arranged in opposed relationship with respect to each other, each guide assembly comprising guide engaging roller means for engaging a guide of said skip, cage, lift or the like, and first and second biasing means operatively connected to said roller means for urging said roller means into rolling contact with said guide, said first biasing means having a lower load bearing capacity than said second biasing means, said first and second biasing means cooperating such that when the guide roller assembly moves towards said guide, said roller means is deflected against the action of said first biasing means by a predetermined distance, whereupon said first biasing means is rendered inoperative and said second biasing means is simultaneously brought into action to resist said load, and when said guide roller assembly moves away from said guide, said first biasing means undergoes extension to maintain said roller means in contact with said guide, there being no coupling of first and second biasing means during said extension of said first biasing means.

22. The system according to claim 21 wherein the respective first biasing means is effectively identical and compressed equally so as to provide equal, opposed, biasing forces; and so as to become inoperative upon an equal degree of deflection of the guide roller means in one direction or the other.

23. A guide roller assembly suitable for a skip, cage, lift or the like, comprising:

guide engaging roller means for engaging a guide of said skip, cage, lift or the like;

first and second biasing means operatively connected to said roller means for urging said roller means into rolling contact with said guide;

roller means support means pivotally mounted on a base of said assembly for providing pivotal movement of said roller means towards said guide;

biasing means support means pivotally mounted on said base and extending transversely of said roller means support means for supporting said first and second biasing means;

stop means mounted on said biasing means support means for rendering said first biasing means inoperative, said stop means being in the form of a shielding cup into which said first biasing means is compressably receivable, said stop means serving to prevent further compression of said first biasing means once said roller means support means is deflected by a predetermined distance and comes into contact with said stop means;

said first biasing means having a lower load bearing capacity than said second biasing means, said first and second biasing means cooperating such that when the guide roller assembly moves towards said guide, said roller means is deflected against the action of said first biasing means by said predetermined distance, whereupon said first biasing means is rendered inoperative and said second biasing means is simultaneously brought into action to resist said load, and when said guide roller assembly moves away from said guide, said first biasing means undergoes extension to maintain said roller means in contact with said guide, there being no coupling of said first and second biasing means and no extension of said second biasing means during said extension of said first biasing means.

* * * * *